US006892834B1

(12) United States Patent
Beck, III

(10) Patent No.: US 6,892,834 B1
(45) Date of Patent: May 17, 2005

(54) PILOTED DRILL BARREL AND METHOD OF USING SAME

(76) Inventor: August H. Beck, III, 10 Hearthwood, San Antonio, TX (US) 78248

( * ) Notice: Subject to any disclaimer, the term of this patent is extended or adjusted under 35 U.S.C. 154(b) by 0 days.

(21) Appl. No.: 09/336,204

(22) Filed: Jun. 18, 1999

(51) Int. Cl.[7] ..... E21B 10/26; E21B 7/00; E21D 9/12

(52) U.S. Cl. ..... 175/385; 175/108; 299/39.4; 299/62

(58) Field of Search ..... 175/108, 385, 175/386, 388, 389, 390, 53, 57; 299/39.1, 299/39.4, 41.1, 55, 58, 59, 60, 61, 62

(56) References Cited

U.S. PATENT DOCUMENTS

| | | | | | |
|---|---|---|---|---|---|
| 369,020 | A | * | 8/1887 | Merdian | 175/388 |
| 2,016,068 | A | * | 10/1935 | Bannister | 173/33 |
| 3,387,673 | A | * | 6/1968 | Thompson | 175/385 |
| 3,593,811 | A | * | 7/1971 | Tedrow | 175/91 |
| 4,013,319 | A | * | 3/1977 | Wise | 173/52 |
| 4,165,130 | A | * | 8/1979 | Mason | 299/62 |
| 4,526,242 | A | * | 7/1985 | Mathieu et al. | 175/94 |
| 4,671,367 | A | * | 6/1987 | Brunsing et al. | 175/253 |
| 4,729,439 | A | | 3/1988 | Kurt | |
| 4,878,547 | A | * | 11/1989 | Lennon | 175/53 |
| 5,174,390 | A | * | 12/1992 | Kurt | 175/407 |
| 5,314,267 | A | * | 5/1994 | Osadchuk | 175/53 |
| 5,931,614 | A | * | 8/1999 | Meyen et al. | 175/386 |
| 6,112,835 | A | * | 9/2000 | Grafe et al. | 175/385 |
| 6,116,356 | A | * | 9/2000 | Doster et al. | 175/385 |
| 6,189,630 | B1 | * | 2/2001 | Beck, III | 175/108 |
| 6,296,068 | B1 | * | 10/2001 | Frederick | 111/116 |

FOREIGN PATENT DOCUMENTS

| | | | |
|---|---|---|---|
| AU | 216928 | * | 5/1958 |
| CA | 1133954 | | 10/1982 |
| CH | 613491 | | 9/1979 |
| DE | 2025439 | * | 12/1970 |

(Continued)

OTHER PUBLICATIONS

Informational Brochure on Keystone Drill Services Inc., no date.

(Continued)

*Primary Examiner*—Robert E. Pezzuto
*Assistant Examiner*—Nathan Mammen
(74) *Attorney, Agent, or Firm*—Akin Gump Strauss Hauer & Feld, LLP

(57) ABSTRACT

A hard rock drill barrel has a barrel portion with a downhole hammer drill disposed therein at the barrel's periphery. A pilot portion, in substantial axial alignment with the barrel but having a smaller diameter, extends distally from the barrel for inserting into a pilot shaft of slightly larger diameter than the pilot portion. In operation, the hammer drill excavates a collar around the pilot shaft when the drill barrel is rotated and supplied with pressurized air, thereby excavating a relative large diameter shaft. The drill barrel is hollow and open at its proximal end to receive and collect cuttings flushed into the shaft above the drill barrel. The piloted drill barrel is adjustable to excavate variable diameter shaft portions, enabling the placement of casing within a larger diameter shaft portion. After adjustment of the drill barrel, smaller-diameter shaft excavation proceeds beyond the casing.

41 Claims, 15 Drawing Sheets

FOREIGN PATENT DOCUMENTS

| | | | |
|---|---|---|---|
| SU | 590445 | * | 12/1970 |
| SU | 369260 | * | 4/1973 |
| SU | 393447 | * | 2/1974 |
| SU | 1364729 | * | 1/1988 |

OTHER PUBLICATIONS

Informational Brochure on the Hole Story—A Guide to Downhole Drills, Ingersoll-Rand Co., (Mar. 1997).

* cited by examiner

PILOTED DRILL BARREL AND METHOD OF USING SAME

FIELD OF THE INVENTION

The invention relates generally to drilling apparatus for excavating relatively large diameter shafts into hard rock, and more particularly to drilling barrels equipped with a downhole hammer.

BACKGROUND OF THE INVENTION

In the foundation drilling industry and in the boring and tunneling industry, it is desired to excavate large diameter shafts (on the order of 36 inches to 84 inches diameter and up) penetrating into very hard rock. In the foundation drilling industry, these shafts are typically filled with reinforced concrete to form foundation piles for buildings, bridges, etc, while in the boring and tunneling industry, these shafts are typically used as access shafts, utility shafts, ventilation shafts, personnel entry shafts or elevator shafts. Often rock augers are used, equipped with tungsten carbide cutting edges. When the rock becomes very hard, the progress of the excavation will virtually stop or reach excavating rates less than 2" per five minute interval with full downward force and with full torque applied to the rock auger.

Alternatively for very hard rock, so-called drilled shaft construction techniques are typically employed, in which a hollow core barrel is rotated so that cutters on its lower edge cut an annular kerf in the rock. Once this kerf is drilled to the desired depth by the core barrel's cutting face, the rock core within the kerf may be broken up and augered out, or broken off and removed.

The foregoing cutting techniques generally require extreme pressure exerted against the core barrel by the drive mechanism, and removal of the core can be very difficult. For applications which only require smaller-diameter shafts (i.e., less than about 34 inches), it is known to use pneumatic, percussive-type downhole drills, which permit significant reductions in the amount of pressure that must be applied to the drilling apparatus. These relatively small downhole "hammer" drills typically employ a drill bit with a circular cutting face having numerous protruding tungsten carbide buttons. A rotary head or kelly-bar drive causes the drill string to rotate in the shaft, and drilling pipes conduct compressed air to a piston (i.e., the hammer) near the end of the drill string, generating percussive blows of the cutting face of the drill bit to the earth at the distal end of the shaft. These percussive blows place the rock in compression, and the retreating drill bit places the rock in tension. This cyclic action, which may occur several hundred times per minute, breaks up the rock, which is then removed by a drilling fluid (often, simply air) which is circulated into the shaft under pressure. Rotation of the drill string brings the drill bit into contact with fresh unbroken rock during successive percussion cycles.

Single downhole drills of the type described are typically from a few inches up to about 34 inches in diameter and excavate the shaft relatively fast. Greater diameters are impractical due to the excessive cost of larger-diameter drill bits, expensive large downhole hammers and increased compressed air requirements. To achieve larger-diameter shafts, it is known to use cluster drills comprising a plurality of hammer drills in a gang construction, as described in U.S. Pat. No. 4,729,439 to Kurt. In gang drills of this type, several hammer drills are arranged within a casing in a ring around a central hammer drill which is concentric with the casing and thus the shaft to be drilled. The cutting faces of the drill bits must be sufficiently large to cut swaths which completely cover the distal end of the shaft. For relatively large diameter shafts, e.g., 36 inches and greater, the number and size of hammer drills required make their use impractical because air and fuel consumption tends to be quite high.

In addition, gang drills suffer from disadvantages such as high cost and high maintenance, with attendant high out-of-service times. Also, gang drills lose efficiency when excavating on sloped or uneven ground. All the hammer bits that are not in contact with the ground at a given time will blow off air and severely impair the hammering ability of the hammer bits that are in contact with the rock. Also, the smaller diameter shanks tend to break off when subjected to side loads during rotation of the barrel, resulting in bit replacement and possible expensive retrieval operations.

Moreover, none of the foregoing prior art tools can drill shafts of different diameters, and thus they are unsuited to drilling shaft portions into which casing is to be placed before further drilling takes place. Also, in a vertical or near-vertical shaft, the foregoing drills can not carry cuttings to the surface without adding a calix basket or other catchment to the top of the tool for carrying out cuttings that are not blown out of the shaft. This makes the overall height of the tool so tall as to interfere with the underside of the rotary table on conventional foundation drill machines, making it difficult to clear the tool from the excavation to dump the cuttings, remove the tool, or inspect the tool.

SUMMARY OF THE INVENTION

What is needed is a drilling apparatus that makes use of downhole hammers and is suitable for drilling large diameter shafts, but does not suffer from the disadvantages of conventional gang drills and large diameter downhole drilling bits. Such a drilling apparatus should also permit the excavation of shaft portions of varying diameters, to advantageously aid in excavating when it is desired to place a casing in aproximal shaft portion and then place the drilling apparatus inside the casing to excavate a shaft portion distal to the casing.

Accordingly, an object of the present invention is to provide an improved large diameter hard rock drill barrel suitable for large diameter applications having lower air and fuel consumption than conventional large diameter gang drills.

A further object of the invention is to provide an improved large diameter hard rock drill barrel having lower manufacturing costs than conventional gang drills and large diameter downhole hammer drills and bits.

Another object of the invention is to provide an improved large diameter hard rock drill barrel having lower maintenance costs and resulting down time during the maintenance process.

Another object of the invention is to provide an improved large diameter hard rock drill barrel having the ability to excavate the entire face of the shaft, thereby eliminating the need to remove the core.

Another object of the invention is to provide an improved large diameter hard rock drill barrel employing downhole hammer apparatus that does not suffer from blow off when drilling on uneven ground.

A further object of the invention is to provide an improved large diameter hard rock drill barrel that aids in carrying cuttings to the surface without extending the length of the barrel with the use of a calix basket or other catchment.

Another object of the invention is to provide an improved large diameter hard rock drill barrel and method for varying the diameter of the drilled shaft.

In satisfaction of these and other objects, the invention provides a barrel with a downhole hammer drill disposed near the periphery of the barrel with a cutting face at the barrel's distal, or working, end. A pressurized air source is coupled to the center of the barrel at its proximal end. A conduit arrangement conducts pressurized air from the proximal end of the barrel to the downhole hammer. The barrel has a diameter suitable for excavating shafts used as tunnels or for piles for buildings, bridges and the like, and is preferably from about 36 inches to 72 inches in diameter, although diameters of 102 inches or more may be realized.

Those skilled in the art will recognize that more than one downhole hammer may be used, although unless these are closely spaced on one side of the barrel, certain benefits of the invention may be lost in whole or in part, such as the benefit of reduced air consumption resulting from reduced blow-off when excavating uneven ground.

The barrel is provided with a pilot portion in axial alignment with the barrel at its working end for insertion into a pilot shaft excavated in advance of placement of the barrel. The pilot shaft is preferably relatively smaller in diameter and excavated using a downhole hammer in the conventional manner. The pilot shaft is preferably at least about ⅓ of the diameter of the final excavation, and best results can be expected using the largest single downhole hammer drill available for a modest cost (presently, about 34 inches in diameter). The pilot portion of the barrel is slightly smaller in diameter than the pilot excavation. After the pilot is inserted into the pilot shaft, pressurized air is directed through a kelly into the conduit and then into the downhole hammer mounted near the periphery of the barrel. The barrel is then rotated in the pilot shaft and the downhole hammer is activated when its bit comes in contact with the rock surface, thereby excavating a collar around the pilot shaft.

The barrel's pilot is preferably provided with an auger flight for removing cuttings from the distal end of the pilot shaft as drilling proceeds. Absent such an auger flight, the pilot shaft may rapidly fill with cuttings from the collar of the excavated shaft, obstructing the pilot and impeding further drilling. The auger flight conducts cuttings from the distal end of the pilot shaft to the interior of the body of the barrel, where it collects until the barrel is removed from the shaft. The barrel is provided with a releasable hatch at its distal end, through which collected cuttings may be removed when the barrel is withdrawn. Preferably, the pilot performs no substantial excavation of hard rock in the pilot shaft, but rather serves to pilot the barrel and collect cuttings from the pilot shaft.

If the starting surface of the excavated shaft is uneven, the high spots are excavated first until an even collar, or shelf, is obtained. At that point, the hammer will constantly hit and excavate the collar as the barrel is turned and advanced. The piloted barrel's downhole hammer strikes the collar of the excavation in tension because the pilot shaft excavation has relieved the compressive strength of the rock. Therefore, when the hammer bit strikes the rock, large sections of the periphery are broken in tension.

If the shaft is to be excavated where there are strata of hard rock and softer earth, conventional softer-earth drilling techniques may be employed to drill the shaft in the stratum of softer material. In this case, the pilot shaft for the piloted drill barrel need only commence at a depth within the larger shaft. To excavate such a pilot shaft, preferably a centering device resembling a wagon wheel is used to help guide the downhole hammer near the center of the shaft.

Once the pilot shaft is excavated to the desired depth, the piloted drill barrel is attached to the air kelly. Air from a pressurized air source is exhausted from the downhole hammer, carrying cuttings out of the shaft excavation to the surface. If the excavated shaft is vertical, such as for a foundation, some of the cuttings fall back into the excavated shaft. The piloted barrel is therefore preferably substantially open at its proximal end to receive these cuttings in the hollow barrel together with the cuttings augered from the distal end of the pilot shaft, and all of the collected cuttings can be carried to the surface and dumped out by opening the hinged hatch described previously.

One side of the pilot may be provided with a shim which is placed on the side of the pilot opposite the downhole hammer to bias the hammer away from the longitudinal axis of the pilot shaft, thereby excavating a slightly larger diameter shaft to accommodate casing placed in the shaft. Such casing may be desirable when drilling through soft overburden to keep water and earthen slough from intruding into the shaft. After the placement of the casing, the shim is placed on the side of the pilot nearest the hammer, forcing the hammer closer to the axis of the pilot shaft to drill a slightly smaller diameter. In the latter configuration, the barrel may be placed inside the casing and advanced therethrough to drill beyond the casing, while the casing protects against encroachment of the overburden into the shaft.

BRIEF DESCRIPTION OF THE DRAWINGS

The present invention is more easily understood with reference to the drawings, in which.

DETAILED DESCRIPTION OF THE PREFERRED EMBODIMENT

Figure 1:
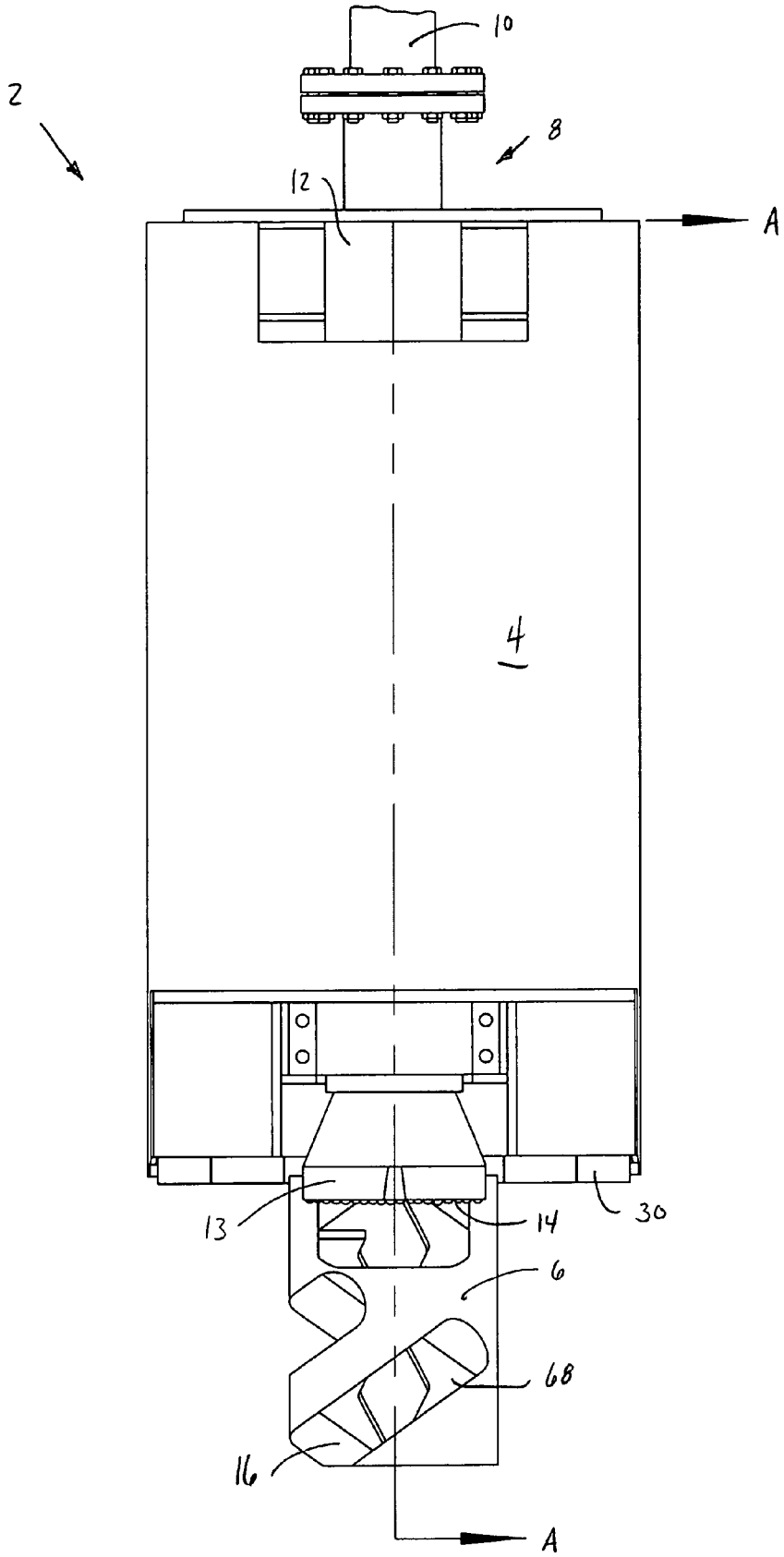
FIG. 1 is a side view of a piloted drill barrel according to the present invention.
Figure 2:
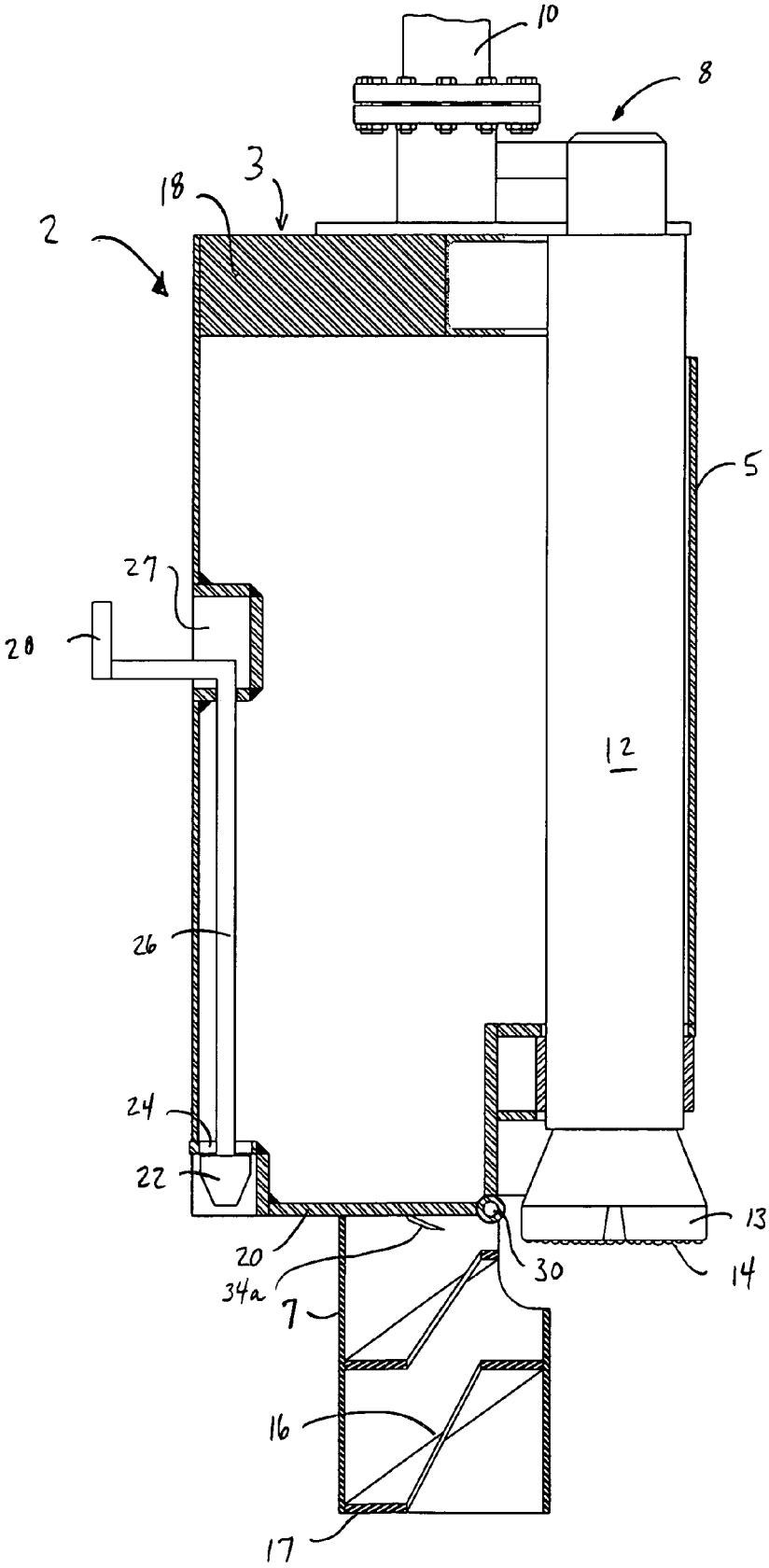
FIG. 2 is a partial sectional view taken along section A—A of FIG. 1.

Referring in more detail to the drawings, there is shown in FIGS. 1 and 2 a piloted drill barrel 2 having a barrel portion 4 and a pilot portion 6. The barrel portion 4 will have an outer diameter slightly less than the diameter of the shaft to be drilled, and about 40.5 inches in the preferred embodiment. Barrel wall 5 will be of a suitable thickness in view of the particular requirements of the excavation, and is about one inch in the preferred embodiment. Downhole hammer drill 12 is suspended rigidly inside barrel portion 4 near its periphery. Hammer drill 12 may be any pressurized air drill suitable for drilling into hard rock. One such drill that has provided acceptable results is available from Ingersoll-Rand and designated model no. QL-120. An assortment of drill bits is available for such drills. A 15 inch-diameter QL-120 drill bit with tungsten carbide buttons at cutting face 14 has proved satisfactory, although the bit selected will depend on several factors, including the diameter of the pilot shaft and the diameter of the larger shaft to be excavated. Also in the preferred embodiment, the hammer drill is customized by removing restraining splines from the drill bit 13 or the chuck (not shown) so that the bit 13 can rotate when the hammer drill is in a dropped position with respect to the barrel 4, thereby subjecting different buttons to the harshest cutting conditions at different times and extending the life of the bit.

Figure 17:
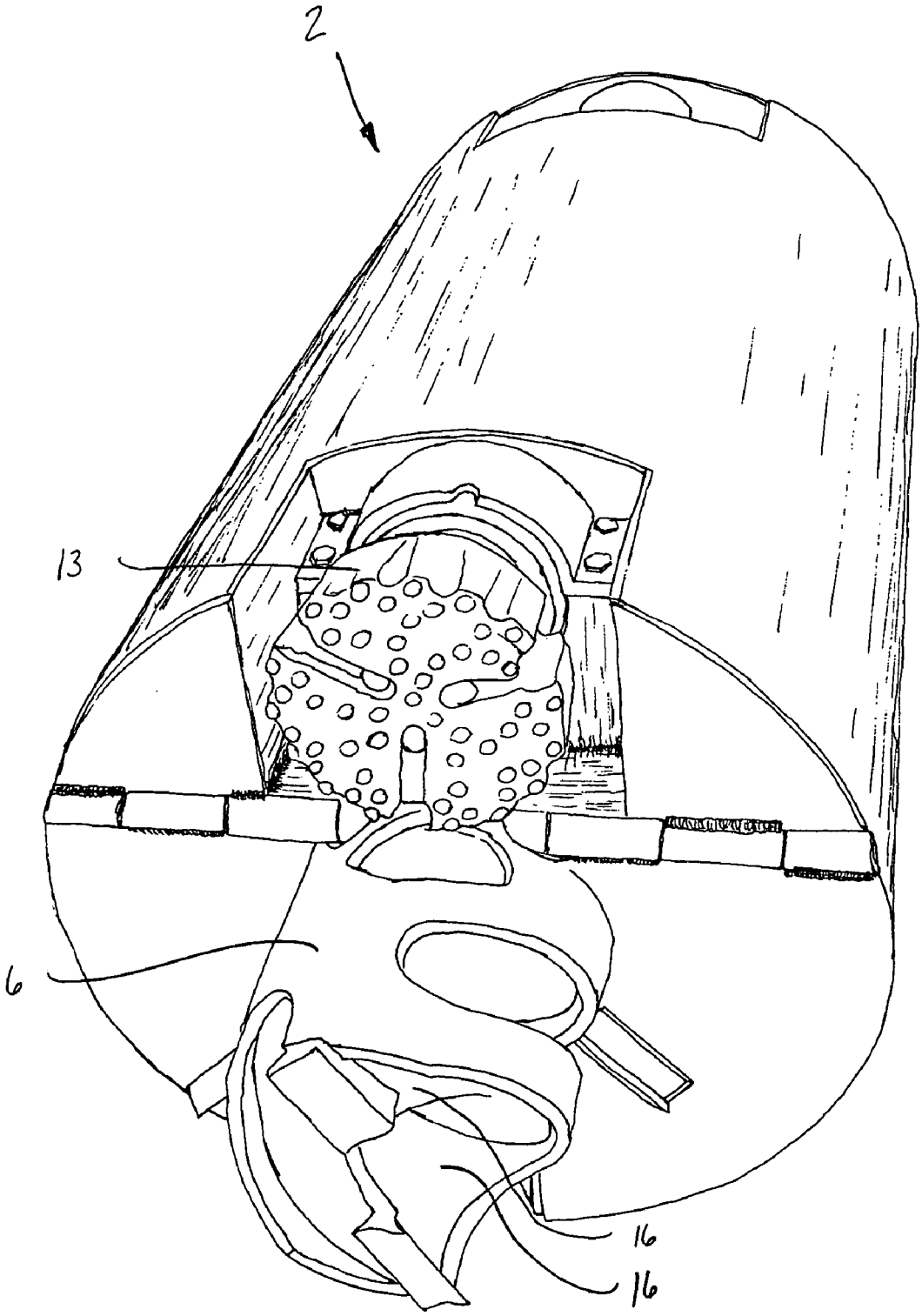
FIG. 17 is a perspective view from the working end of a piloted drill barrel according to the present invention.

Cylindrical pilot 6 extends distally from barrel portion 4 and is preferably secured thereto permanently, such as by welding. Pilot 6 has a wall 7 of outer diameter corresponding to, but somewhat smaller than, the pilot shaft. Pilot 6 preferably includes one or more auger flights 16, each auger flight including a pick-up blade 17 for conveying cuttings from within the pilot shaft upward into the interior of barrel portion 4 when the drill barrel is rotated. Cuttings are freely conveyed along the auger flights through the distal end of the barrel portion, where they are collected. One or more pilot windows 68 are preferably cut into pilot wall 7 so that cuttings may contact the pilot shaft wall, thereby aiding each auger flight 16 to propel the cuttings into the interior of barrel portion 4. FIG. 17 is a perspective view of the piloted drill barrel 2, particularly showing bit 13 of the downhole hammer, pilot portion 6, and auger flights 16.

Section A—A in FIG. 2 shows details not visible in FIG. 1. Upon rotation of drill barrel 2, cutting face 14 of drill bit 13 cuts a collar around the pilot shaft, leaving cuttings on the collar, or shelf. These cuttings are taken into the interior of barrel portion 4 by angled collecting blades 34*a* and 34*b* (hidden) through windows 32*a* and 32*b* (FIG. 3) during drilling. When the piloted drill barrel 2 is withdrawn from the excavated shaft, cuttings collected during drilling are preferably released through a hinged hatch 20 in the distal end of barrel portion 4. Hatch 20 swings about hinge 30 upon activation of hatch release 22, which is coupled to handle 28 via a rod 26 extending outwardly from recess 27 and then alongside the periphery of barrel portion 4 to the hatch release. During drilling, rod 26 and handle 28 are rotated to lie completely within barrel portion 4 and recess 27, and hatch release 22 is sized so that it cannot pass through aperture 24. Upon removal of the drill barrel from the excavation, rod 26 is rotated by pulling handle 28 outward from recess 27, thereby permitting hatch release 22 to pass through aperture 24, which causes hinged hatch 20 to fall and release collected cuttings. These and other details of the piloted drill barrel may be seen in the perspective view of FIG. 17.

Figure 5:
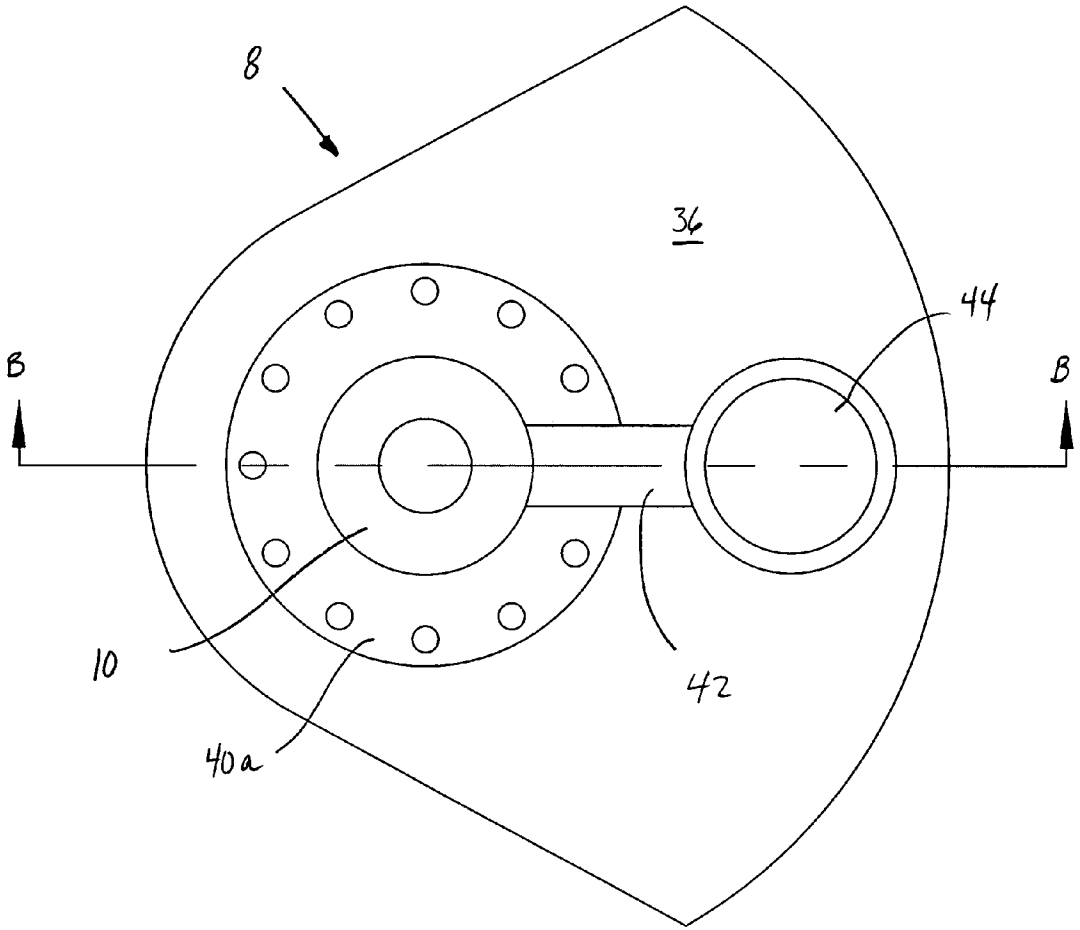
FIG. 5 is a top plan view of a plate assembly for attaching an air kelly and a downhole hammer to the piloted drill barrel.
Figure 6:
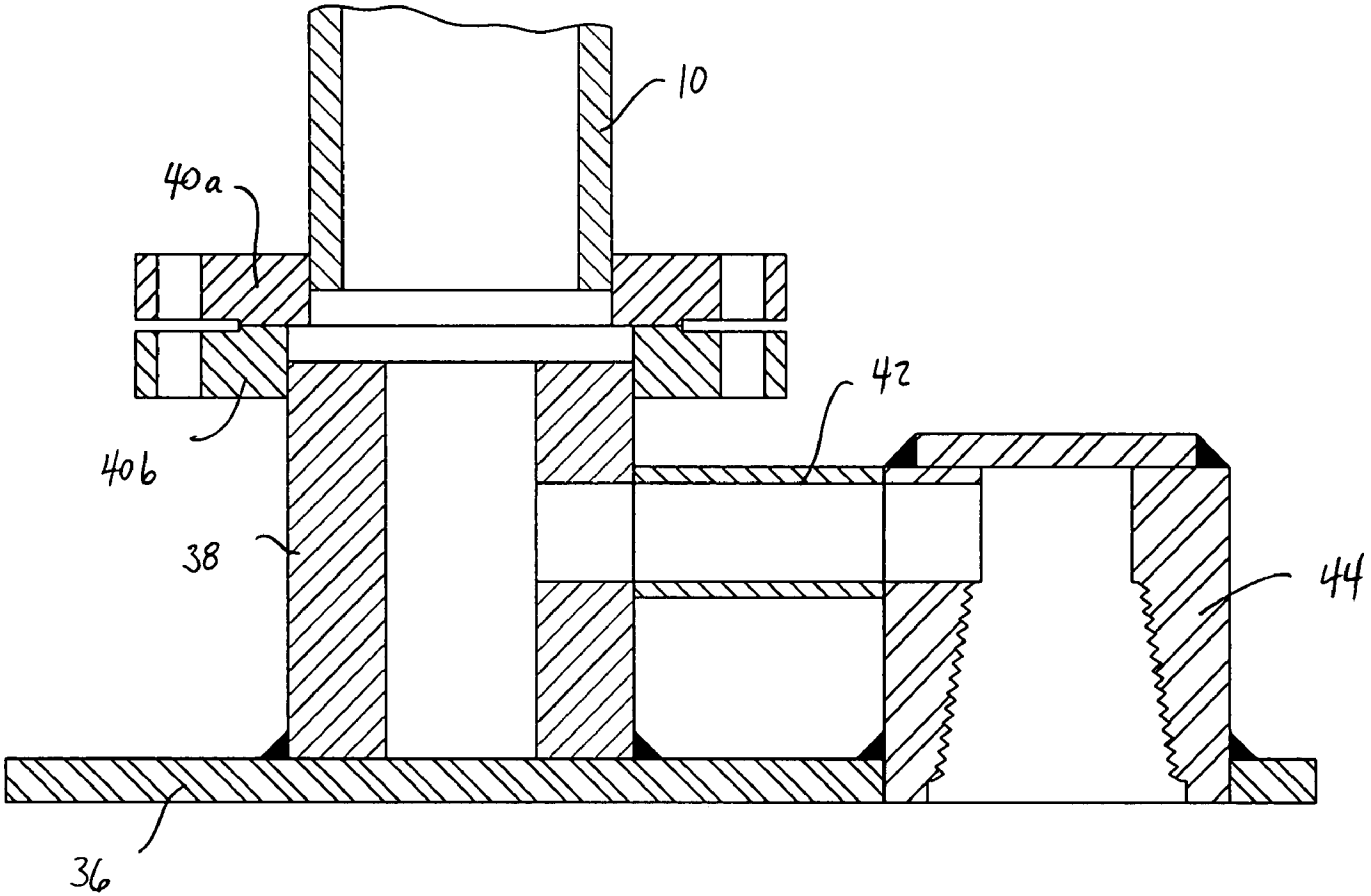
FIG. 6 is a cross-sectional view of the plate assembly taken along section B—B of FIG. 5.

Connector assembly 8, described more fully below with respect to FIGS. 5 and 6, is secured to a plurality of beam flanges 18 on barrel portion 4, and couples drill barrel 2 to drive mechanism 10. Drive mechanism 10 is preferably an air kelly suitable for rotating the drill barrel and supplying pressurized air to hammer drill 12. Connector assembly 8 also securely retains the proximal end of hammer drill 12 and conducts pressurized air to an air inlet in the proximal end of hammer drill 12.

Figure 3:
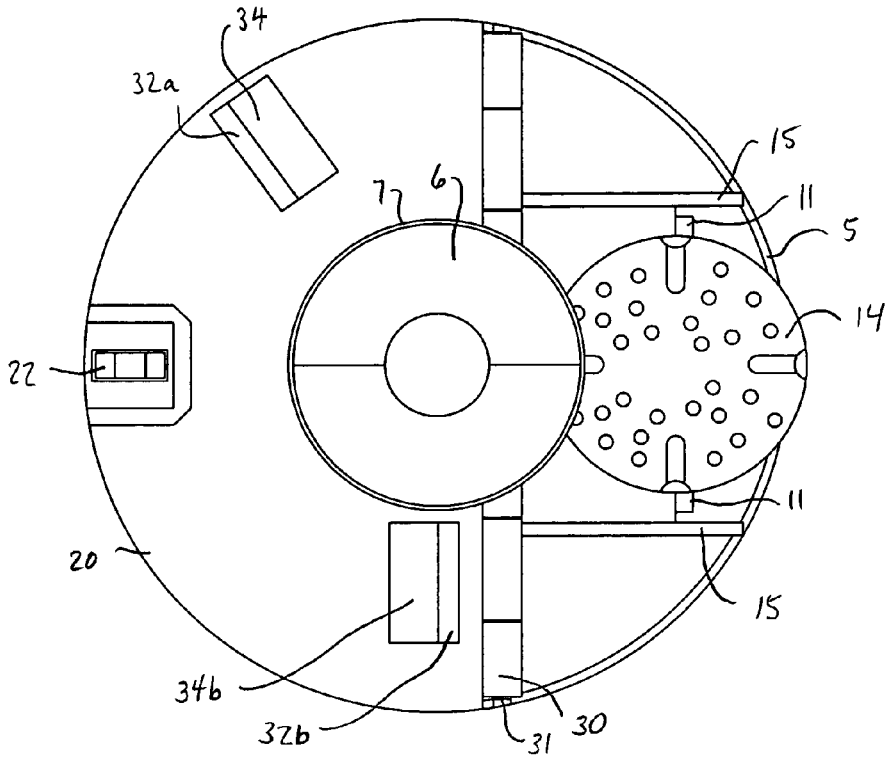
FIG. 3 is a plan view of the working end of the drill barrel of FIG. 1.
Figure 4:
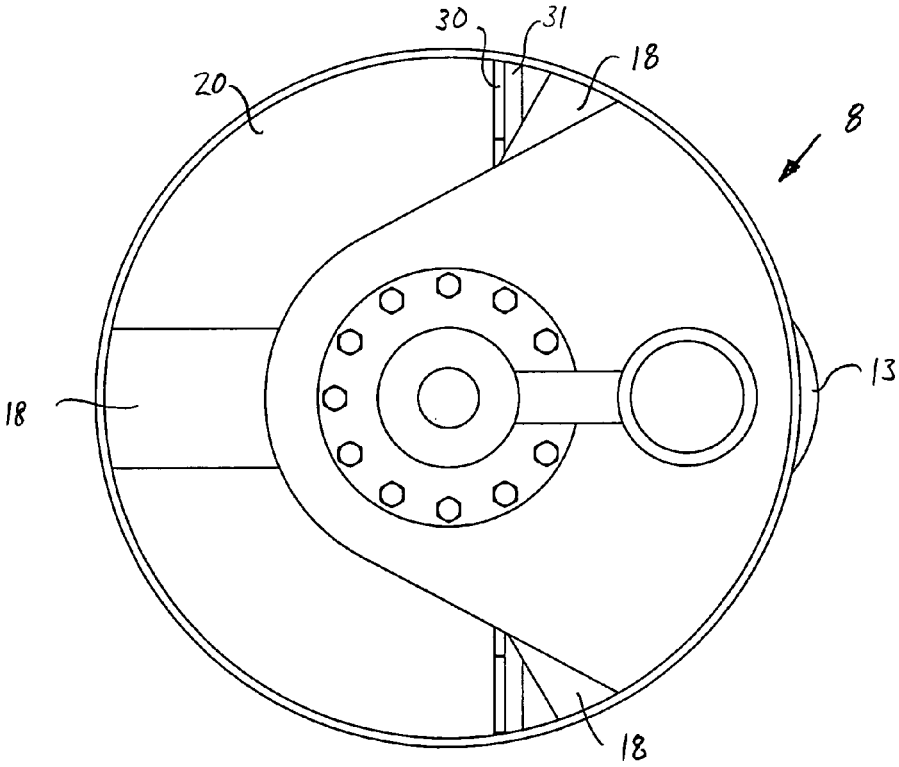
FIG. 4 is a plan view of the proximal end the drill barrel of FIG. 1.

Distal and proximal end views of the drill barrel of FIG. 1 are shown in FIGS. 3 and 4, respectively. FIG. 3 shows cutting face 14 of hammer drill 12 positioned to extend just beyond the outer diameter of barrel wall 5 to cut a shaft slightly larger in diameter than the barrel. The working end of the hammer drill is supported and held rigid by securing it with bolted clamp assembly 11 which is supported by vertical walls integrally formed with barrel wall 5. Pilot 6 need not overlap radially with cutting face 14 if complete cutting of the collar can be achieved without such overlap.

Hatch 20 is coupled to hinge 30, which in turn is secured to interior vertical wall 31, such as by welding. Hatch release 22 is shown in the open position. Hatch 20 includes window and take-up blade mechanisms to remove cuttings from the drilled collar by collecting them within the body of the drill barrel. Outer window 32*a* and angled collecting blade 34*a* are positioned near the periphery of hatch 20 to wipe the outer portion of the drilled collar, while inner window 32*b* and its collecting blade 34*b* are positioned radially inward to wipe the inner portion of the drilled collar.

FIG. 4 depicts connector assembly 8 secured to beam flanges 18, which are mounted inside the proximal end of barrel portion 4. Particularly useful when excavating vertical shafts, connector assembly 8 is of limited extent so as to leave proximal end 3 (FIG. 2) of barrel portion 4 substantially open, thereby permitting cuttings that are not flushed out of the shaft during drilling to fall inside the barrel and collect above hinged hatch 20 for later removal. Such an arrangement obviates the need to place a calix basket atop the drill barrel to catch these cuttings.

With reference to FIGS. 5 and 6, the components of connector assembly 8 are shown in greater detail. Base plate 36 is preferably welded to beam flanges 18 (FIG. 4). Hammer retainer 44 is inserted through an aperture in base plate 36 and welded to the base plate. Hammer retainer is API threaded to securely mate with a conventional hammer drill and hold it firmly in place within the drill barrel. Drive mechanism 10 preferably rotates the drill barrel and provides a source of pressurized air for the hammer drill. Air inlet 38 is preferably a pipe that transmits the rotational torque from drive mechanism 10 to the drill barrel, and also conducts pressurized air to the hammer drill via air tube 42 coupled between the air inlet and hammer retainer 44. Drive mechanism 10 and air inlet 38 are fastened together at coupling flanges 40*a* and 40*b*, such as by bolting.

Figure 7:
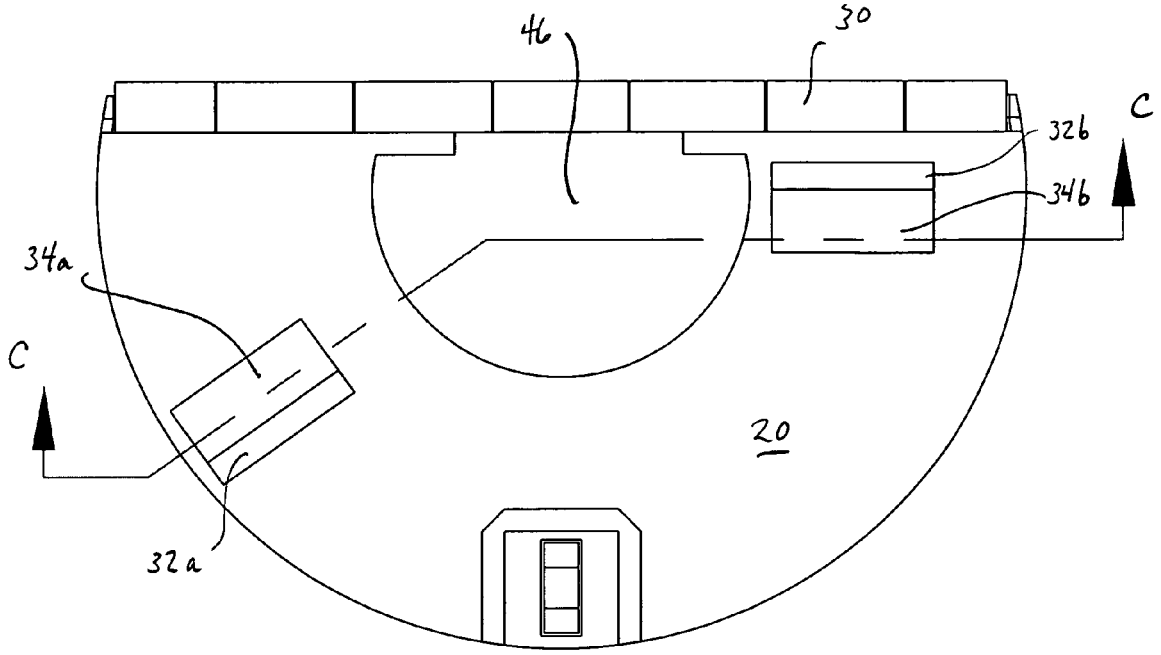
FIG. 7 is a plan view of a hinged hatch for removing cuttings from the interior of the piloted core barrel.
Figure 8:
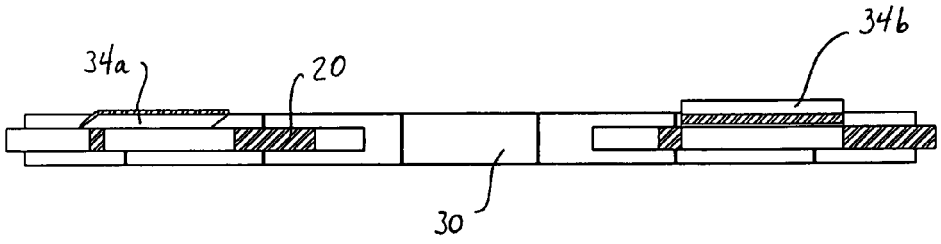
FIG. 8 is a cross-sectional view of the hinged hatch taken along section C—C of FIG. 7.

FIGS. 7 and 8 illustrate further details of hinged hatch 20, particularly including collecting blades 34*a* and 34*b*. Hatch 20 is formed with a pilot receptacle 46 for receiving an end of the pilot cylinder, which may be secured within the receptacle by welding. Hinge 30 permits the hatch and the pilot secured thereto to swing down and release cuttings from the drill barrel when it is withdrawn from the excavated shaft. Outer window 32*a* and inner window 32*b* penetrate hatch 20. Collecting blades 34*a* and 34*b* extend at an angle away from an edge of their respective windows to collect cuttings from the shaft collar when the drill barrel is rotated during drilling.

Referring now to FIGS. 9–16, the excavation of a relatively large diameter shaft with the drill barrel of the present invention is described. It will be readily apparent to those skilled in the art that the invention may be used to excavate horizontal shafts or angled shafts, and the illustration of a vertical shaft is not to be taken as a limitation of the invention.

Drilling commences with the excavation of a pilot shaft. The pilot shaft may be excavated by any conventional technique for producing a relatively small diameter (preferably, 34 inches or less) shaft in hard rock. The pilot shaft is preferably as large in diameter as may be economically produced; the larger the pilot shaft, the narrower the collar that must be excavated with the piloted drill barrel when producing the relatively large diameter excavated shaft. Of course, the diameter of the pilot shaft should be only slightly larger than the diameter of pilot 6 on drill barrel 2. It has proven satisfactory to employ an air hammer of the type used in the inventive drill barrel to excavate the pilot shaft.

Figure 9:
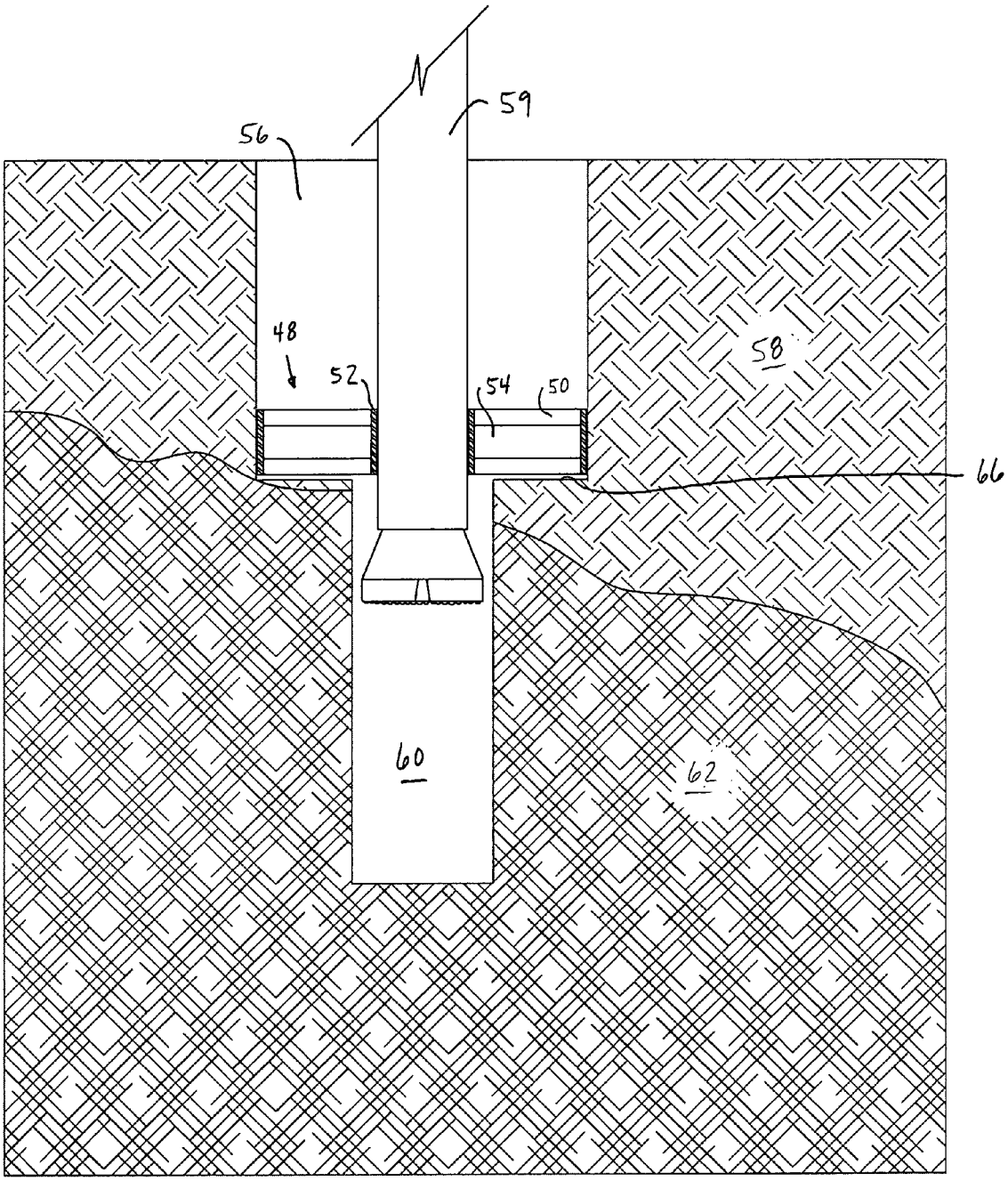
FIG. 9 illustrates the excavation of a pilot shaft to accommodate the piloted drill barrel.
Figure 10:
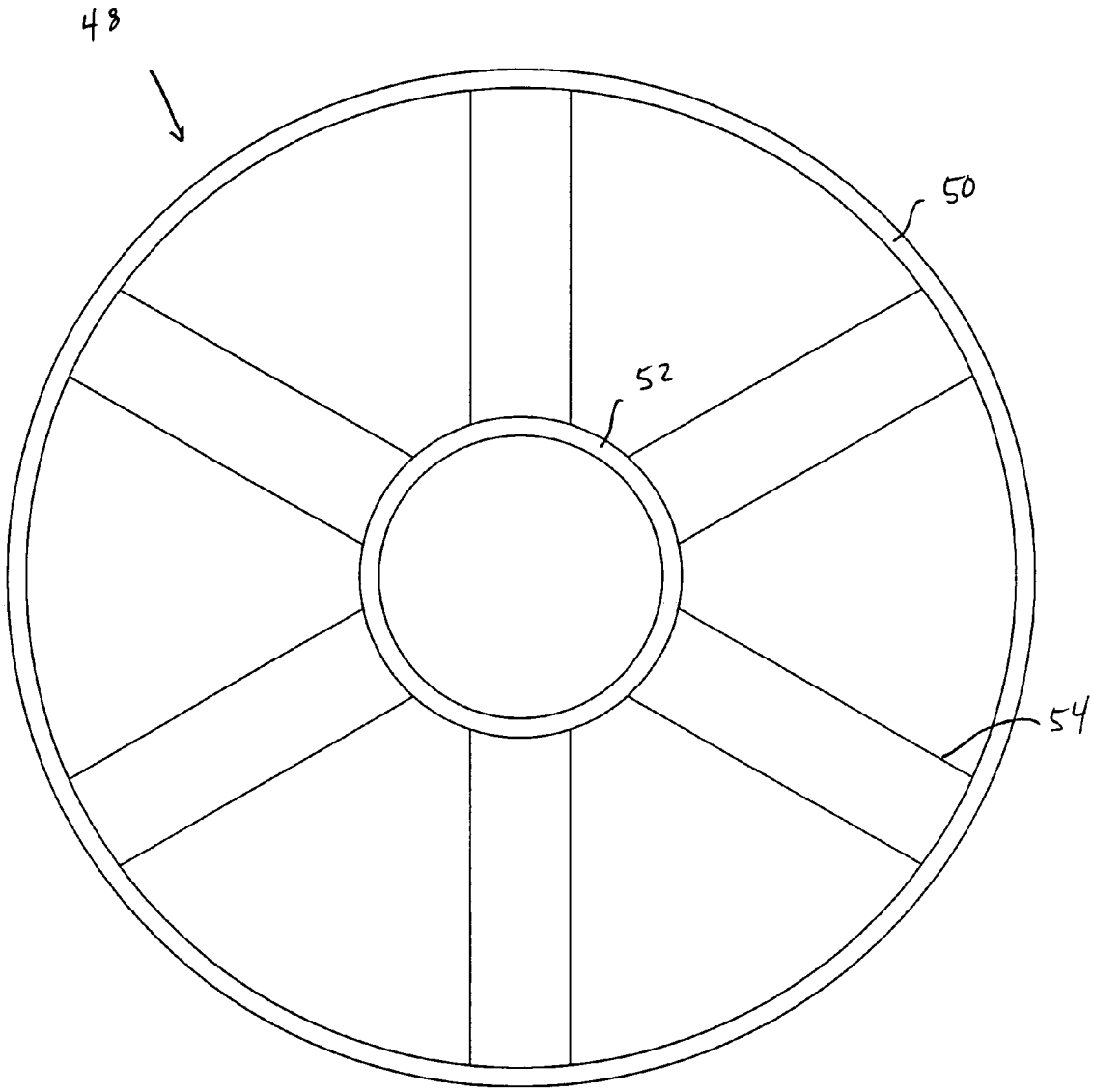
FIG. 10 is a plan view of a tool for guiding a downhole hammer when excavating a pilot shaft at the end of a larger diameter shaft.

FIG. 9 illustrates the use of a pilot hammer drill 59 to excavate pilot shaft 60 in hard rock 62. If hard rock 62 prevails at the surface, pilot shaft 60 will commence at the surface. However, typically a stratum of softer ground or overburden 58 lies above the hard rock 62 to be drilled. In these circumstances, excavation of shaft 56 may commence with conventional techniques for drilling large diameter shafts, such as augering and the like, and continues through overburden 58. When the hard rock 62 is encountered, pilot hammer drill 59 is positioned at the end of foundation shaft 56 and centered therein with guide tool 48 to excavate pilot shaft 60 so as to be concentric with excavated shaft 56. Guide tool 48 is preferably a simple "wagon wheel" structure, as shown in FIG. 10. Inner ring 52, which fits loosely around pilot hammer drill 59 and rests on collar 66, is maintained concentric with outer ring 50 by a plurality of spokes 54.

Figure 11:
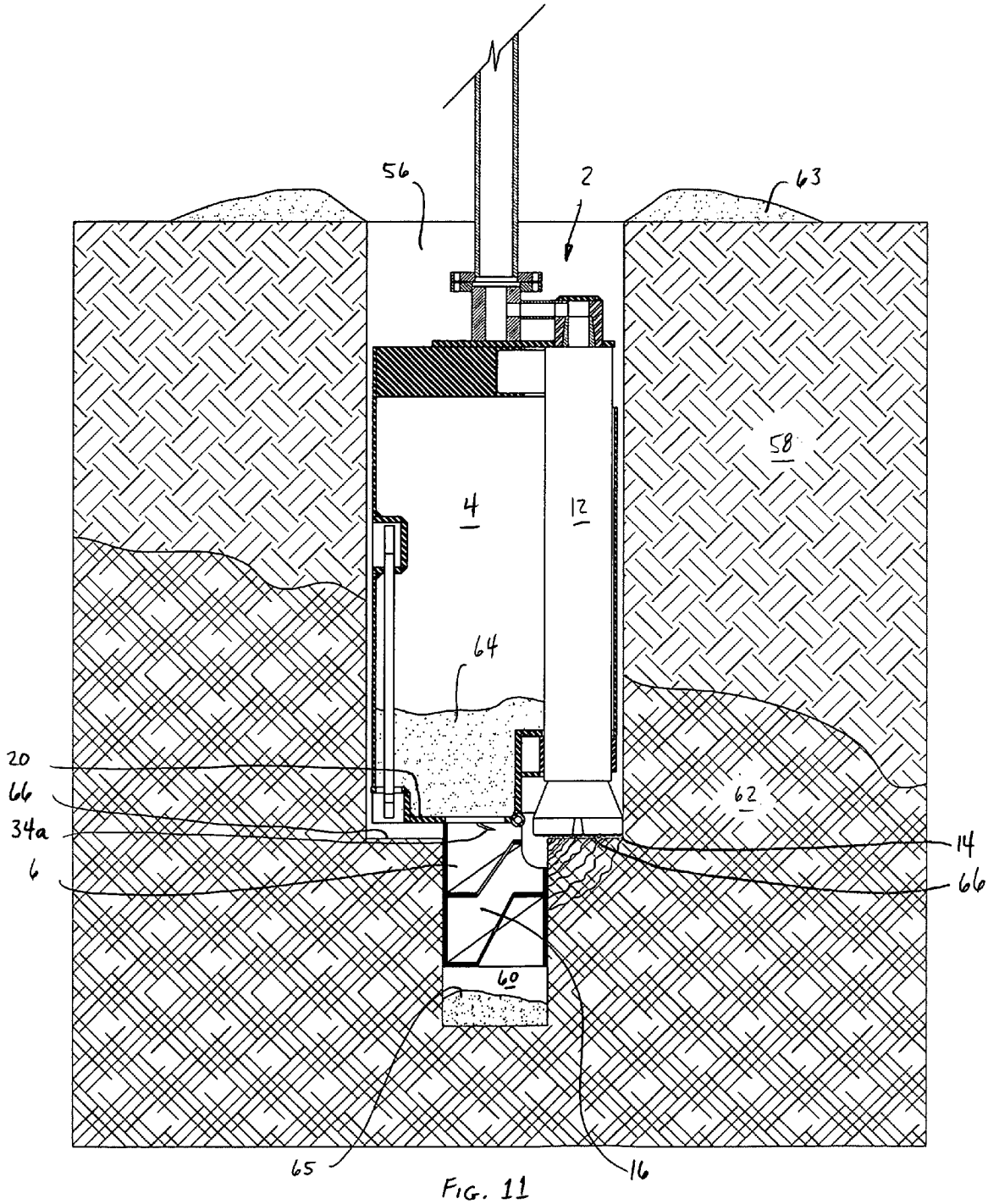
FIG. 11 is a partial cross-sectional view of the piloted drill barrel in operation, showing cuttings collecting in the end of a pilot shaft and inside the barrel.

After a pilot shaft is excavated, drilling of the large diameter shaft with drill barrel 2 proceeds, as shown in FIG. 11. Cutting face 14 of hammer drill 12 excavates collar 66 around pilot shaft 60 when the drill barrel is rotated. The hard rock of collar 66 is in tension, since compressive forces have been substantially relieved by the excavation of pilot shaft 60. The drilling efficiency of hammer drill 12 is thereby enhanced, and hard rock 62 tends to be broken off in large pieces when impacted by cutting face 14. Some of these cuttings remain on collar 66 and are collected by collecting blades 34*a* and 34*b* (hidden). The collected cuttings 64 are retained within barrel portion 4 during drilling. Other cuttings are forced past the side wall of drill barrel 2 by pressurized air exhausted from hammer drill 12. Ejected cuttings 63 collect outside excavated shaft 56, while other cuttings fall back through the substantially open proximal end of barrel portion 4 to become part of collected cuttings 64. Still other cuttings drop into pilot shaft 60. These pilot shaft cuttings 65 are taken up by auger flight 16 within pilot 6 and deposited among collected cuttings 64, which are preferably removed via hatch 20 when drill barrel 2 is withdrawn from excavated shaft 56.

Figure 12:
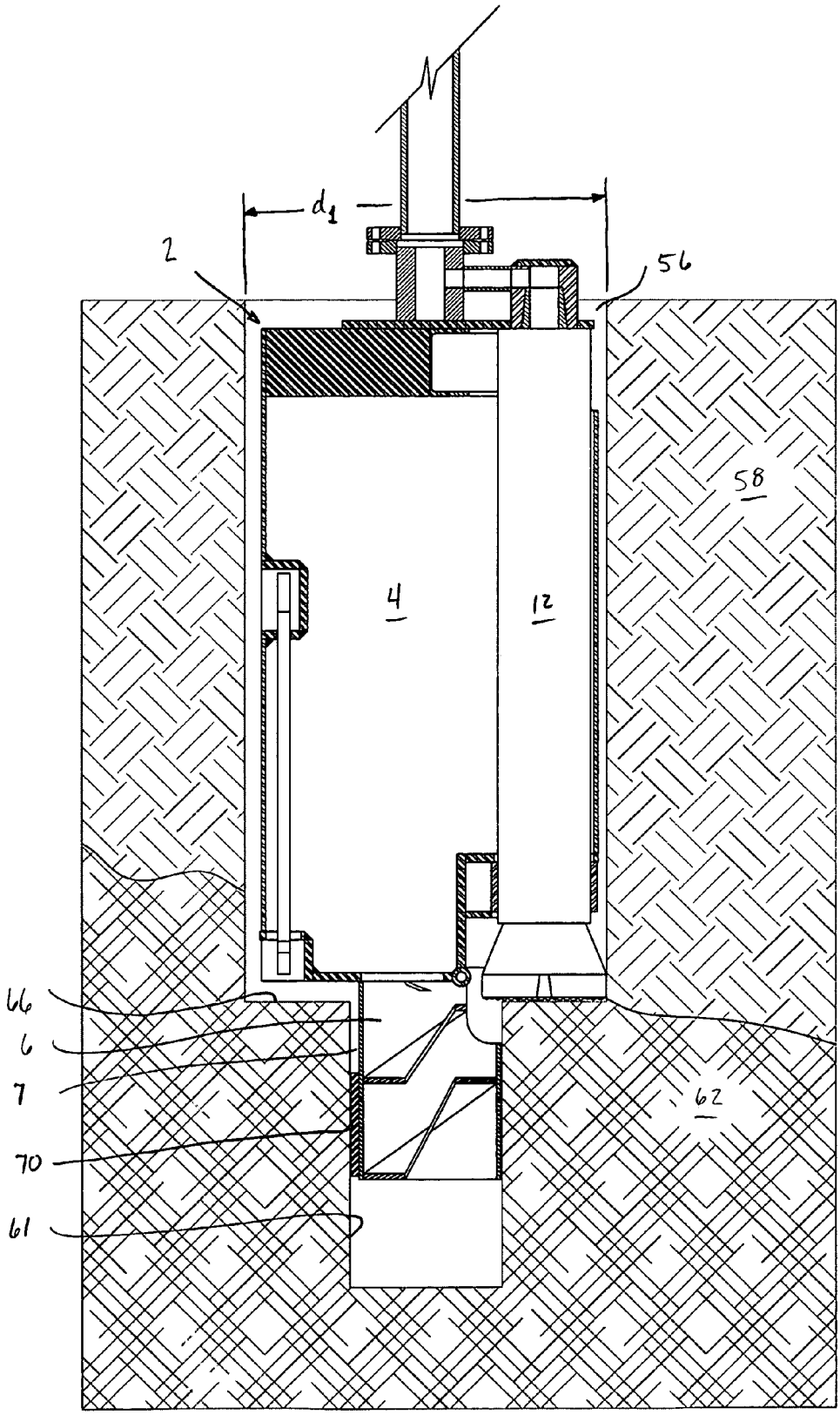
FIG. 12 is a partial cross-sectional view of the piloted drill barrel configured to excavate a relatively larger diameter to accommodate a casing.
Figure 13:
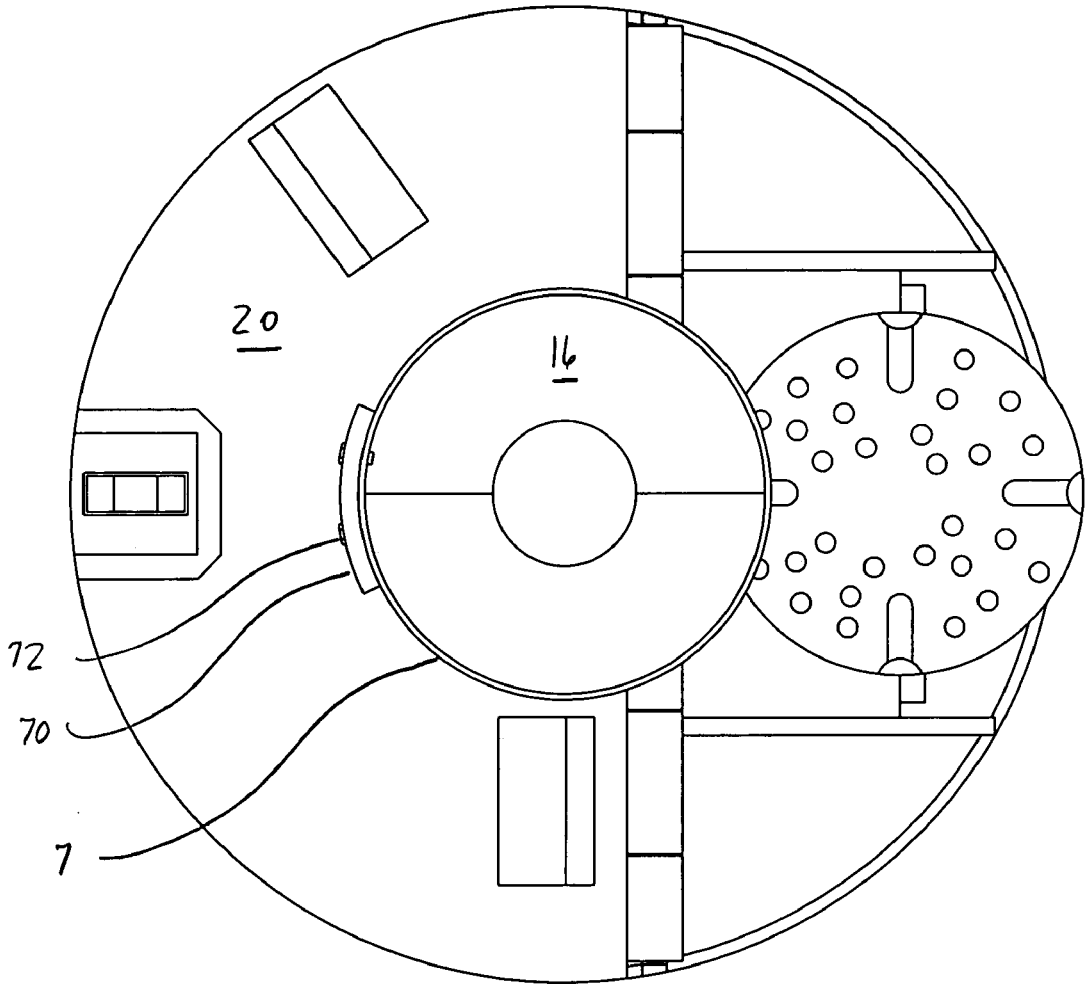
FIG. 13 illustrates the placement of the shim on the piloted drill barrel of FIG. 12.

Referring now to FIG. 12, there is shown an embodiment of the piloted core barrel for excavating a larger diameter section of excavated shaft 56 that is suitable for placement of casing. In this embodiment, a shim 70 is secured against pilot wall 7 opposite hammer drill 12. The placement of shim 70 between pilot shaft wall 61 and pilot wall 7 biases hammer drill 12 away from the longitudinal axis of the pilot shaft and excavated shaft, thereby excavating collar 66 to produce a section of shaft of diameter $d_1$. Shim 70 is preferably removably fastened to pilot wall 7 with bolts 72, as shown in FIG. 13, although any suitable means of securing shim 70 may be employed.

Figure 14:
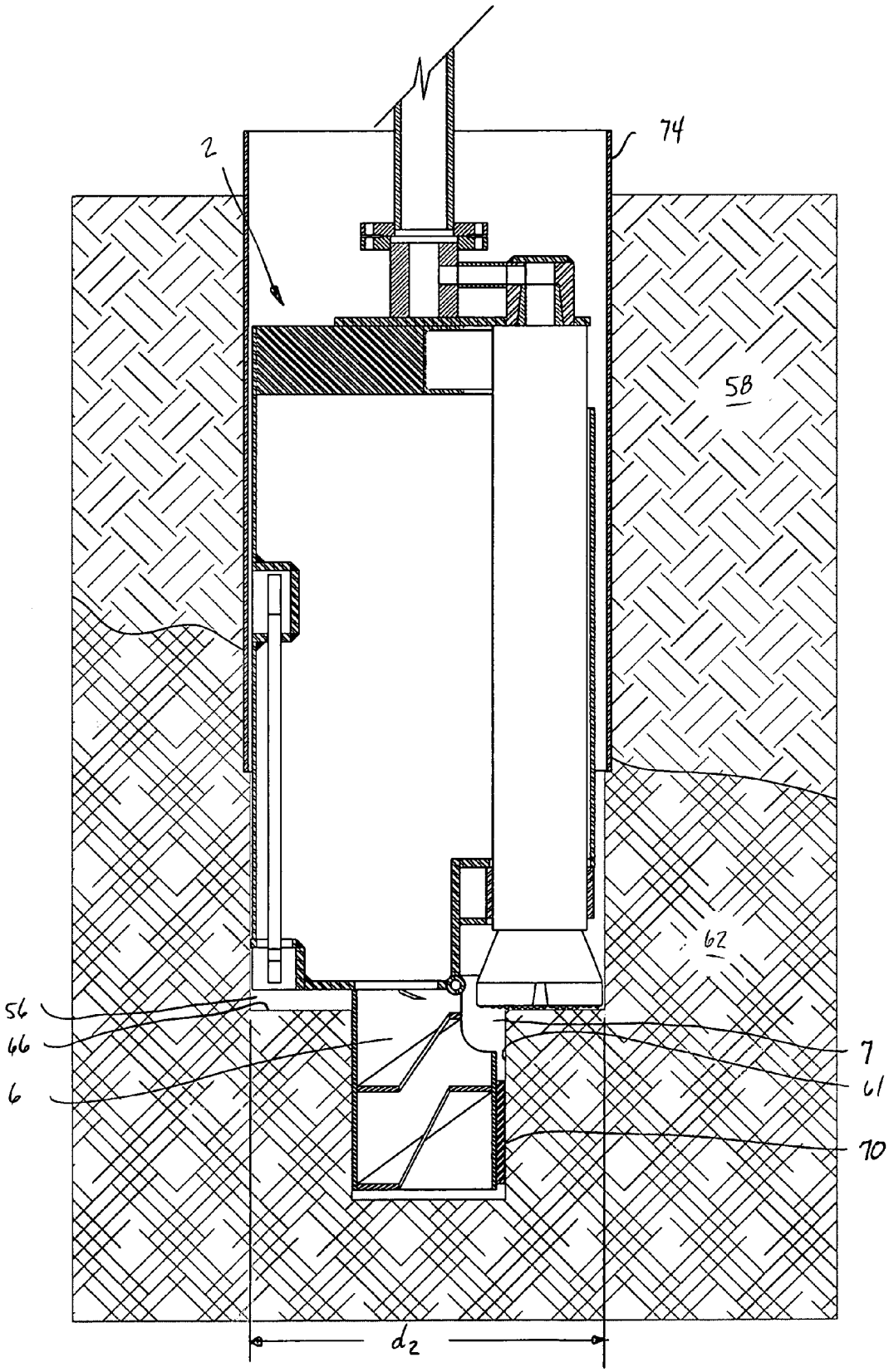
FIG. 14 is a partial cross-sectional view of the piloted drill barrel configured to excavate a relatively smaller diameter beyond a casing.
Figure 15:
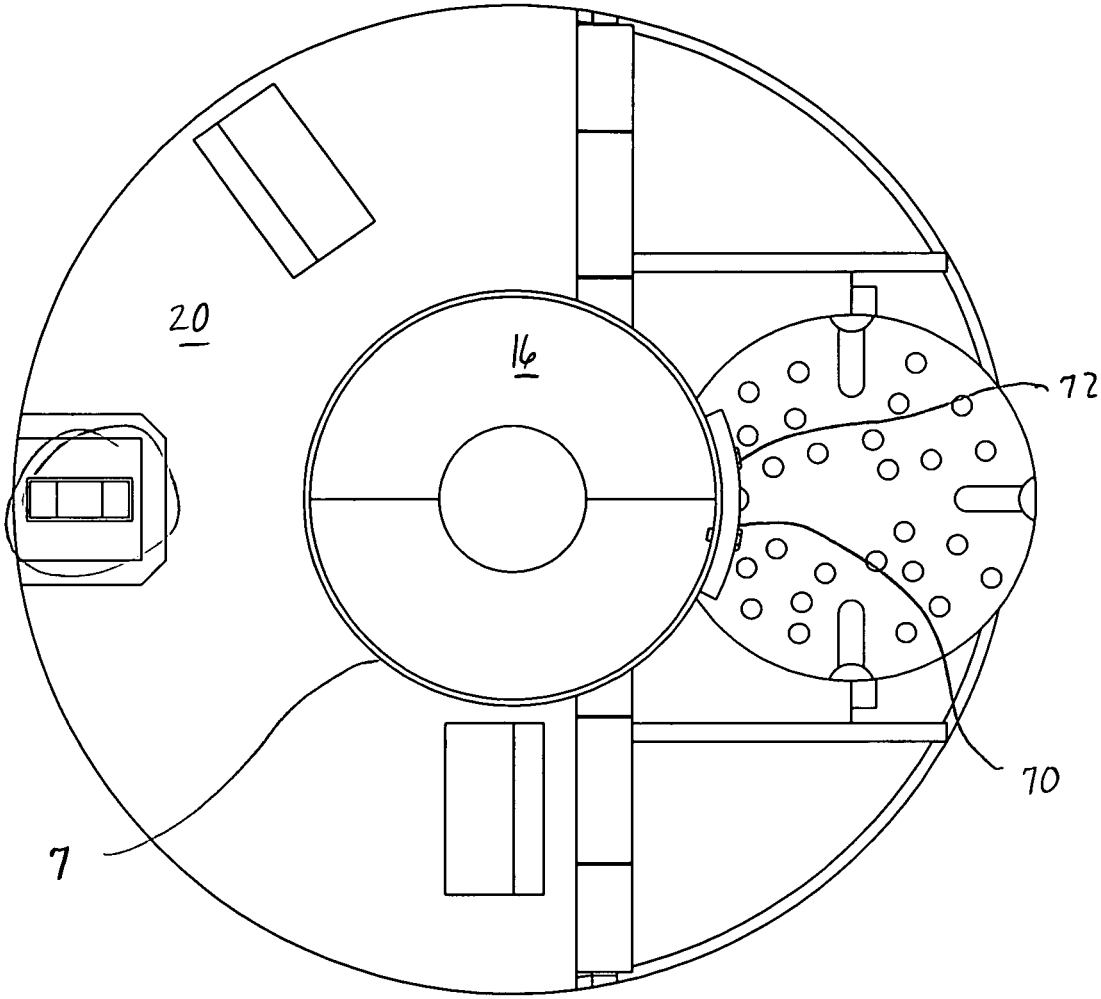
FIG. 15 illustrates the placement of the shim on the piloted drill barrel of FIG. 14.

Once a section of excavated shaft 56 having diameter $d_1$ is produced, a casing may be placed in that section of the shaft, preferably to guard against intrusion of water and earthen material from overburden 58. To allow piloted drill barrel 2 to continue excavating shaft 56 within casing 74, shim 70 is repositioned on pilot wall 7 to lie along the same radius as hammer drill 12, as shown in FIGS. 14 and 15. This placement of shim 70 urges hammer drill 12 toward the longitudinal axis of the pilot shaft and excavated shaft, thereby excavating collar 66 to produce a section of shaft of diameter $d_2$ which is less than $d_1$. The degree of variation between drilled diameters will depend on the thickness of shim 70, which in turn is limited by the difference in diameters of pilot 6 and pilot shaft 60. In addition, it can be seen that, for a given thickness of shim 70, maximum variation of shaft diameters is obtained by placing shim 70 generally along a diameter of the piloted drill barrel that intersects hammer drill 12.

Figure 16:
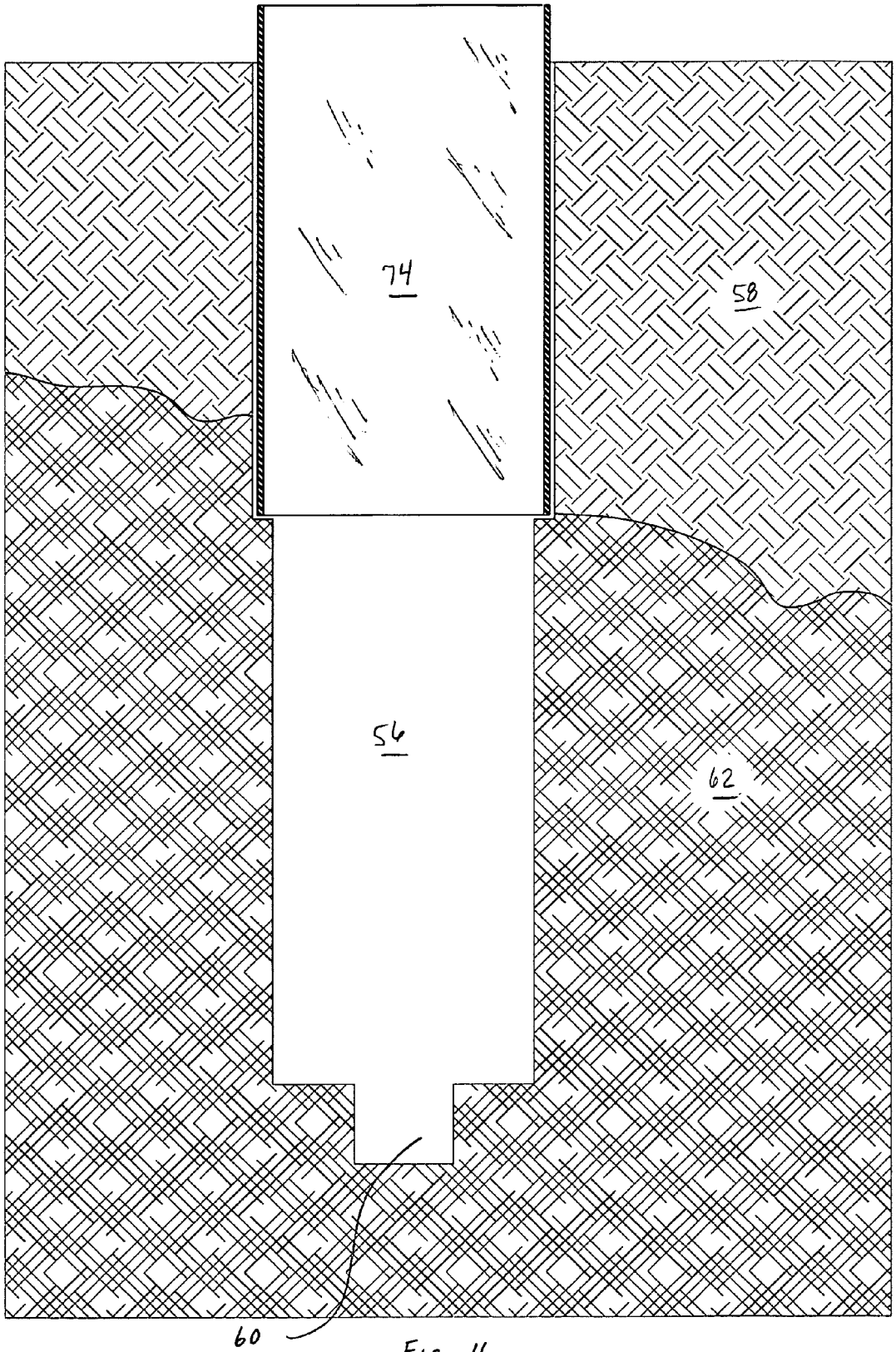
FIG. 16 shows a pilot shaft and two portions of larger-diameter shaft excavated by the piloted drill barrel.

There is depicted in FIG. 16 a completed shaft 56 excavated according to the inventive method, including pilot portion 60 that necessarily remains at the end of the shaft. Excavated shaft 56 may have one or more sections of casing 74, as permitted by the variable diameter feature of the piloted drill barrel 2.

While a particular embodiment of the invention has been illustrated and described, it will be obvious to those skilled in the art that various changes and modifications may be made without sacrificing the advantages provided by the principles of construction and operation disclosed herein.

What is claimed is:

1. A piloted drill barrel for excavating a shaft in hard rock or other relatively hard earthen material comprising:

a barrel portion comprising a downhole hammer drill disposed substantially within said barrel portion near the barrel portion's periphery for excavating a collar around a pilot shaft; and a pilot portion formed integrally and axially aligned with said barrel portion and extending distally therefrom to pilot said barrel portion along said pilot shaft during excavation of a larger diameter shaft.

2. The piloted drill barrel of claim 1, wherein the pilot portion comprises an auger flight positioned to convey cuttings out of said pilot shaft.

3. The piloted drill barrel of claim 2, wherein said piloted drill barrel is open to said auger flight, thereby permitting said cuttings from said pilot shaft to be deposited within said barrel portion.

4. The piloted drill barrel of claim 3, further comprising a releasable hatch in said barrel portion at its distal end for removing cuttings deposited in said barrel portion.

5. The piloted drill barrel of claim 4, wherein said drill barrel has a diameter of at least about 36 inches.

6. The piloted drill barrel of claim 1, wherein said barrel portion is substantially open at its proximal end for receiving cuttings during operation of said piloted drill barrel.

7. The piloted drill barrel of claim 6, further comprising a releasable hatch in said barrel portion at its distal end for removing cuttings deposited in said barrel portion.

8. The piloted drill barrel of claim 7, wherein said drill barrel has a diameter of at least about 36 inches.

9. The piloted drill barrel of claim 1, further comprising at least one window in said barrel portion at its distal end, said window having a collecting blade extending therefrom to collect cuttings from said collar through said window during operation of the piloted drill barrel.

10. The piloted drill barrel of claim 9, further comprising a releasable hatch in said barrel portion at its distal end for removing cuttings deposited in said barrel portion.

11. The piloted drill barrel of claim 10, wherein said drill barrel has a diameter of at least about 36 inches.

12. A piloted drill barrel adapted to excavate shafts of varying diameters in bard rock or other relatively hard earthen material, comprising:

a barrel portion comprising a downhole hammer drill disposed substantially within said barrel portion near the barrel porton's periphery for excavating a collar around a pilot shaft;

a pilot portion axially aligned with said barrel portion and extending distally therefrom to pilot said barrel portion along said pilot shaft during excavation of a larger diameter shaft; and a shim releasably secured to said pilot portion at its outer wall and generally along a diameter of said piloted drill barrel intersecting said hammer drill, said shim tending to urge said piloted drill barrel out of axial alignment with said pilot shaft, thereby to excavate said collar with a different diameter that can be obtained without said shim.

13. The piloted drill barrel of claim 12, wherein the pilot portion comprises an auger flight positioned to convey cuttings out of said pilot shaft.

14. The piloted drill barrel of claim 13, wherein said piloted drill barrel is open to said auger flight, thereby permitting said cuttings from said pilot shaft to be deposited within said barrel portion.

15. The piloted drill barrel of claim 14, filer comprising a releasable hatch in said barrel portion at its distal end for removing cuttings deposited in said barrel portion.

16. The piloted drill barrel of claim 15, wherein said drill barrel has a diameter of at least about 36 inches.

17. The piloted drill barrel of claim 12, wherein said barrel portion is substantially open at its proximal end for receiving cuttings during operation of said piloted drill barrel.

18. The piloted drill barrel of claim 17, for comprising a releasable hatch in said barrel portion at its distal end for removing cuts deposited in said barrel portion.

19. The piloted drill barrel of claim 18, wherein said drill barrel has a diameter of at least about 36 inches.

20. The piloted drill barrel of claim 12, further comprising at least one window in said barrel portion at its distal end, said window having a collecting blade extending therefrom to collect cuttings from said collar through said window during operation of the piloted drill barrel.

21. The piloted drill barrel of claim 20, further comprising a releasable hatch in said barrel portion at its distal end for removing cuttings deposited in said barrel portion.

22. The piloted drill barrel of claim 21, wherein said drill barrel has a diameter of at least about 36 inches.

23. A drill barrel having a proximal end and a distal end for excavating a shaft in hard rock or other relatively hard earthen material, comprising:

a barrel portion, said barrel portion being substantially hollow and substantially open at its proximal end;

a downhole hammer drill disposed substantially within said barrel portion near the barrel portion's periphery; and a releasable hatch in said barrel portion at its distal end for removing cuttings deposited in said barrel portion.

24. The drill barrel of claim 23, wherein said drill barrel has a diameter of at least about 36 inches.

25. A method of excavating a relatively large diameter shaft in hard rock or other relatively hard earthen material, comprising the steps of:

excavating a pilot shaft; and excavating a collar around said pilot shaft said collar excavating step comprising:

inserting a piloted drill barrel partially into said pilot shaft, said piloted drill barrel having (a) a barrel portion comprising a hammer drill extending distally therefrom near said barrel portion's periphery, and (b) a pilot portion formed integrally and in substantial axial alignment with said barrel portion and having a diameter suitable for piloting said barrel portion during excavation;

supplying pressurized air to said hammer drill, thereby to activate said hammer drill; and rotating said piloted drill barrel with a drive mechanism.

26. The method of claim 25, further comprising the step of angering cuttings out of said pilot shaft with an auger flight in said pilot portion.

27. The method of claim 26, further comprising the step of collecting said cuttings within said barrel portion.

28. The method of claim 27, further comprising the step of removing said cuttings through a releasable hatch in said barrel portion at its distal end.

29. The method of claim 25, wherein said barrel portion is substantially open at its proximal end for receiving cuttings during operation of said piloted drill barrel.

30. The method of claim 29, further comprising the step of removing said cuttings through a releasable hatch in said barrel portion at its distal end.

31. The method of claim 25, further comprising the step of collecting cuttings from said collar through a window in said barrel portion at its distal end during operation of the piloted drill barrel.

32. The method of claim 31, further comprising the step of removing said cuttings through a releasable hatch in said barrel portion at its distal end.

33. A method of excavating a relatively large diameter shaft in hard rock or other relatively hard earthen material, said shaft having more than one diameter to accommodate a casing in a portion thereof, comprising the steps of:

excavating a pilot shaft, providing a drill barrel having (a) a barrel portion comprising a hammer drill extending distally therefrom near said barrel portion's periphery, (b) a pilot portion in substantial axial alignment with said barrel portion, and (c) a shim releasably secured to said pilot portion at its outer wall opposite said hammer drill;

inserting said pilot portion into said pilot shaft and rotating said piloted drill barrel with a drive mechanism, thereby excavating a first shaft portion having a first diameter;

placing a casing in said first shaft portion;

repositioning said shim to said pilot portion outer wall near said hammer drill;

excavating a second shaft portion having a second, smaller diameter beyond said casing by rotating said piloted drill barrel with said repositioned shim.

34. The method of claim 33, further comprising the step of angering cuttings out of said pilot shaft with an auger flight in said pilot portion.

35. The method of claim 34, further comprising the step of collecting said cuttings within said barrel portion.

36. The method of claim 35, further comprising the step of removing said cuttings through a releasable hatch in said barrel portion at its distal end.

37. The method of claim 33, wherein said barrel portion is substantially open at its proximal end for receiving cuttings during operation of said piloted drill barrel.

38. The method of claim 37, further comprising the step of removing said cuttings through a releasable hatch in said barrel portion at its distal end.

39. The method of claim 33, further comprising the step of collecting cuttings through a window in said barrel portion at its distal end during operation of the piloted drill barrel.

40. The method of claim 39, further comprising the step of removing said cuttings through a releasable hatch in said barrel portion at its distal end.

41. A drill barrel having a proximal end and a distal end for excavating a shaft in hard rock or other relatively hard earthen material, comprising:

a barrel portion, said barrel portion being substantially hollow and substantially open at its proximal end and adapted to receive cuttings deposited in laterally-spaced relation to a downhole hammer drill;

the downhole hammer drill disposed substantially within the barrel portion near the barrel portion's periphery; and a releasable hatch in said barrel portion at its distal end for removing cuttings deposited in said barrel portion.

* * * * *